US010154686B2

(12) United States Patent
Heidtmann

(10) Patent No.: US 10,154,686 B2
(45) Date of Patent: Dec. 18, 2018

(54) TUBE FILLING APPARATUS

(71) Applicant: Raoul John Heidtmann, Cape Town (ZA)

(72) Inventor: Raoul John Heidtmann, Cape Town (ZA)

(73) Assignee: PT MITRA PRODIN, Denpasar Timur, Bali (ID)

( * ) Notice: Subject to any disclaimer, the term of this patent is extended or adjusted under 35 U.S.C. 154(b) by 26 days.

(21) Appl. No.: 14/893,769

(22) PCT Filed: May 23, 2014

(86) PCT No.: PCT/IB2014/061655

§ 371 (c)(1),
(2) Date: Nov. 24, 2015

(87) PCT Pub. No.: WO2014/188383

PCT Pub. Date: Nov. 27, 2014

(65) Prior Publication Data

US 2016/0120212 A1 May 5, 2016

(30) Foreign Application Priority Data

May 24, 2013 (ZA) ..... 2013/03792

(51) Int. Cl.

| | |
|---|---|
| ***A24C 5/02*** | (2006.01) |
| ***A24C 5/42*** | (2006.01) |
| ***A24C 5/39*** | (2006.01) |

(52) U.S. Cl.
CPC ..... *A24C 5/02* (2013.01); *A24C 5/393* (2013.01); *A24C 5/42* (2013.01)

(58) Field of Classification Search
CPC ..... A24C 5/02
(Continued)

(56) References Cited

U.S. PATENT DOCUMENTS 45,575 A * 12/1864 Berg ..... A24C 5/42 131/70
190,541 A * 5/1877 Bromwell ..... A24C 5/42 131/70

(Continued)

FOREIGN PATENT DOCUMENTS

| | | |
|---|---|---|
| DE | 3605052 A1 | 8/1987 |
| DE | 8711945 U1 | 1/1988 |
| WO | 02/056714 A1 | 7/2002 |

OTHER PUBLICATIONS

International Search Report dated Oct. 10, 2014; PCT/IB2014/061655.

*Primary Examiner* — Eric Yaary
*Assistant Examiner* — Russell E Sparks
(74) *Attorney, Agent, or Firm* — Ladas & Parry LLP

(57) ABSTRACT

This invention concerns a tube filling apparatus (10). The apparatus includes a base (40) and a filling assembly (20) mountable on the base (40). The filling assembly (20) has a number of tube receiving recesses wherein tubes may, in use, be received. The apparatus (10) further includes a vibration plate (32) which is locatable between the base (40) and the filling assembly (20). In use, the tubes rest on the vibration plate (32) when they are located in the recesses. The apparatus (10) may also include transducer such as a speaker which is connected to the vibration plate (32) for, in use, vibrating the vibration plate (32), which is capable of moving independently from the filling assembly (20). This invention also concerns a method of filling tubes.

33 Claims, 8 Drawing Sheets

(58) Field of Classification Search
USPC ..... 131/70; 15/257.1
See application file for complete search history.

(56) References Cited

U.S. PATENT DOCUMENTS

| | | | | | |
|---|---|---|---|---|---|
| 361,248 | A * | 4/1887 | Winton | H01F 7/0252 | 206/818 |
| 1,364,360 | A * | 1/1921 | Emery | F04D 25/084 | 15/344 |
| 1,724,735 | A * | 8/1929 | Selbach | A24C 5/42 | 131/73 |
| 3,534,424 | A * | 10/1970 | Levinson | A47L 13/52 | 15/105 |
| 5,400,466 | A * | 3/1995 | Alderman | A47L 9/06 | 15/363 |
| 6,549,860 | B1 * | 4/2003 | Lillard | B06B 1/0253 | 310/334 |
| 2003/0234332 | A1 * | 12/2003 | Yen | F16M 11/28 | 248/404 |
| 2007/0107738 | A1 * | 5/2007 | Barnes | A24C 5/02 | 131/70 |
| 2011/0114104 | A1 * | 5/2011 | Demmer | A24C 5/40 | 131/281 |
| 2012/0055495 | A1 * | 3/2012 | Dahan | A24C 5/02 | 131/289 |

* cited by examiner

TUBE FILLING APPARATUS

BACKGROUND TO THE INVENTION

This invention relates to a tube filling apparatus. In particular, but not exclusively, the invention relates to an apparatus for filling paper tubes with processed plant material, such as a herb mixture, for example.

Paper, cellulose or hemp tubes are often filled by processed plant material, such as a herb mixture, to allow it to be set alight so that it can be smoked. Traditionally, paper tubes have been filled manually by inserting an amount of herb mixture into the tube and thereafter compacting the mixture by striking it on a hard surface until a desired density is obtained. This manual process of filling tubes typically takes about two to three minutes, depending on the quantity, quality and density of the fill required.

A number of different devices have been suggested to address the shortcomings of the manual filling process. In one of these known devices a compacted cartridge of the herb mixture is inserted into the paper tube using a sliding mechanism. The problem with this device is that only one paper tube can be filled at a time. In another device, which allows multiple paper tubes to be filled, a number of vertically arranged tube receiving cavities is provided in a body made from polystyrene. The empty paper tubes are placed in the recesses and then filled manually with the herb mixture. The herb mixture inside the paper tubes is then compacted by lifting the body and dropping it onto a hard surface. This is repeated until the desired fill density has been reached. Although this device allows the herb mixture in the various tubes to be compacted simultaneously, one of its disadvantages is that it still requires a user to impact the polystyrene assembly on a hard surface manually.

Yet another known device includes a number of paper tube holders which are, in use, carried pivotally at the ends of arm extending from a vertically arranged shaft. The paper tubes are placed in cavities in the holders and filled with the herb mixture. After the tubes have been filled the vertical shaft is spun in order to use centrifugal force to compact the herb mixture in the tubes. One major disadvantage of this device is that it includes many movable components which require maintenance in order to keep it in working condition. The device is also bulky as its rotating arms take up a fair amount of space. Yet another disadvantage of this known device is that the filled tubes often require further compacting to achieve an acceptable density.

Another, more compact, device includes a holder which again has a number of tube receiving cavities which are, in use, arranged vertically. The holder is supported on a base to which an electrical motor is attached. A counterweight is attached to the shaft of the electrical motor to cause the base to vibrate in order to compact the herb mixture in the paper tubes inside the cavities in the holder. The holder is carried on top of the vibrating assembly and, in addition to drifting around on the assembly, it is also required that both the base and holder be vibrated during the compacting process. It has been found that the base's displacement is minimal and, accordingly, the effect on the tubes and herb mixture is also minimal. As a result a very loose fill is achieved, which is far from desirable. The herb mixture density achieved by using this device is roughly about half of that achieved by manually compacting the mixture by striking it on a hard surface. It is believed that this is due to a rotational movement being imparted onto the tubes as opposed to a desired bouncing, impacting movement.

Yet another known device includes a filling assembly which is, in use, supported by a housing forming the base of the device. A number of paper tubes are placed in the filling assembly and filled with the herb mixture. Inside the base an electrical motor is mounted to drive a cam mounted on a shaft. A mechanical coupling in the form of a belt drive is used to transfer rotation of the motor shaft to the cam carrying shaft. The filling assembly is mounted above the cam so that rotation of the cam carrying shaft results in the cam striking the bottom of the filling assembly to administer a series of jolts or raps on the filling assembly. To ensure that the herb mixture inside the tubes is compacted, the tubes and cavities in which they are housed allow for a tight fit so that the tube and filling assembly moves in harmony during the compacting process. One problem with this known device is that it again includes many movable components. However, a more serious disadvantage is that it requires the entire filling assembly to be vibrated to compact the herb mixture. The combined weight of the tubes, herb mixture and filling assembly places limitations on the magnitude of displacement that can be realistically and safely applied. It is also not ideal simply to increase the size of the electrical motor and mechanical components causing the vibrating action to improve the achieved mixture density as this would result in the increase in overall costs, size and weight of the device. The increase in the size of the electrical motor and mechanical components would also impact the rise time and dead stroke time of the filling assembly.

It has been found that the known methods and devices as described above either do not allow for the simultaneous filling of multiple paper tubes or for the compacting of the herb mixture to a satisfactory degree. When using the known devices it is generally required that the herb mixture be compacted further manually after having removed the paper tubes from the devices in order to get a satisfactory herb mixture density.

It is an object of this invention to alleviate at least some of the problems experienced with known methods and devices.

It is a further object of this invention to provide a tube filling apparatus that will be a useful alternative to existing devices.

SUMMARY OF THE INVENTION

In accordance with a first aspect of the invention there is provided a tube filling apparatus for filling tubes with a herb mixture, the apparatus including:

a base;

a filling assembly mountable on the base, the filling assembly having a number of tube receiving recesses wherein tubes may be received;

a vibration plate being locatable between the base and the filling assembly such that, in use, the tubes rest on the vibration plate when they are located in the recesses; and vibrating means which is in connection with the vibration plate for, in use, vibrating the vibration plate;

wherein the vibration plate is capable of moving independently from the filling assembly.

The vibrating means may include a transducer, such as a speaker for example, for transferring oscillating electromechanical energy to the vibration plate.

The speaker is preferably connected to the vibration plate by means of a coupling element which connects a speaker cone of the speaker to the vibration plate so that the vibration of the speaker cone is, in use, transferred to the vibration plate, thereby vibrating the tubes resting on the vibration plate.

In one embodiment the vibrating means includes three speakers, each being connected to the vibration plate by means of a coupling element.

The vibration plate is preferably manufactured from thin aluminium sheeting.

The filling assembly may be removably attachable to the base at a fixed height above the base by means of supports, thereby allowing the filling assembly to be removed from the base. Preferably, the filling assembly is magnetically attachable to the base.

The filling assembly may include a lower assembly and an upper assembly, which is, in use, mounted removably on top of the lower assembly, wherein the upper and lower assemblies have a number of tube receiving recesses, and wherein the tube receiving recesses in the upper assembly align with the recesses in the lower assembly when mounted on the lower assembly.

The filling assembly may be height adjustable with respect to the base in order to adjust the distance between the lower assembly and the vibration plate located between the lower assembly and the base, thereby facilitating the extraction of filled tubes after the filling process has been completed. For example, the filling assembly may be mounted on the base by means of adjustable pillars.

Each of the upper and lower assemblies may include a top support, a bottom support and a series of receptacles running between the top and bottom supports, wherein the receptacles define the tube receiving recesses in which the tubes are, in use, received.

The receptacles are preferably transparent so as to allow visual inspection of the process of filling the tubes with the herb mixture. In one embodiment the transparent receptacles are manufactured from glass to reduce the build-up of static charges as a result of friction between the tubes and receptacles.

The apparatus may further include a filling tray being connectable to the upper assembly in a position wherein it is, in use, located above the upper assembly, wherein the filling tray includes recesses which correspond with the recesses in the upper assembly when mounted thereon.

Yet further the apparatus may include a sliding plate being receivable between the filling tray and the upper assembly so as to block off the recesses in the filling tray from the recesses in the upper assembly. The sliding plate is preferably removable so as to allow it to be removed after the recesses in the filling tray have been filled with the herb mixture, thereby allowing the herb mixture to fall into the tubes inside the filling assembly upon removal of the sliding plate.

The apparatus may also include a fan blower mounted in a fan housing having a body, which is connected to the base, and a cover for directing the airflow over the vibration plate. The cover may be removably connectable to the fan housing body so that it can be removed to allow access to the fan blower. The fan housing cover is preferably magnetically coupled to the fan housing.

The apparatus may further include a collector tray being connected to the base on the side of the base which is opposite to the side to which the fan housing is connected, thereby allowing the excess herbal mixture to be blown off the vibration plate and into the collector tray. The collector tray may be removably connectable to the base so that herb mixture collected therein can be re-used. Preferably, the collector tray is reversible, i.e. capable of being re-attached to the base in an orientation which differs 180 degrees from its initial orientation, so that its floor creates a working surface when it is attached to the base in its reversed orientation.

In accordance with a second aspect of the invention there is provided a method of filling tubes with a herb mixture using an apparatus which has a filling assembly mountable on a base and a vibration plate located between the filling assembly and the base, the method including the steps of:

- inserting the tubes into recesses inside the filling assembly;
- resting the tubes on the vibration plate;
- inserting the herb mixture into the tubes; and
- reciprocating the inside the recesses by causing the vibration plate to move independently with respect to the filling assembly.

The filling assembly is preferably kept stationary while the vibration plate is being moved.

The vibration plate may be moved by using a transducer, such as a speaker for example, for transferring oscillating electro-mechanical energy to the vibration plate.

In the preferred embodiment the displacement of the vibration plate is automatically controlled by means of a microprocessor based controller which allows optimised pre-sets to be selected.

The surface displacement of the vibration plate is preferably between about 5 to 7 mm.

The step of inserting the herb mixture into the tubes may further include the following steps:

- placing a filling tray on top of the filling assembly so that recesses in the filling tray align with the tube receiving recesses in the filling assembly;
- blocking off the recesses in the filling tray from the recesses in the filling assembly using a slide plate located between the filling tray and the filling assembly;
- placing the herb mixture in the recesses in the filling tray; and
- removing the slide plate to allow the herb mixture inside the recesses in the filling tray to pass into the tubes located in the recesses inside the filling assembly.

The method may also include the step of collecting excess herb mixture which is, in use, spilt on the vibration plate in a collection tray. The excess herb mixture is preferably collected in the collection tray by causing a flow of air over the vibration plate towards the collection tray.

The method may include removing the collector tray, changing its orientation with respect to the base and re-attaching it to the base in a new orientation so that its floor creates a working surface.

The method may yet further include the steps of removing the filling assembly from the base and placing it on the working surface so that the tubes therein protrude from the filling assembly so that they can easily extracted.

BRIEF DESCRIPTION OF THE DRAWINGS

The invention will now be described in more detail, by way of example only, with reference to the accompanying drawings in which.

DESCRIPTION OF THE ILLUSTRATED EMBODIMENT

Figure 1:
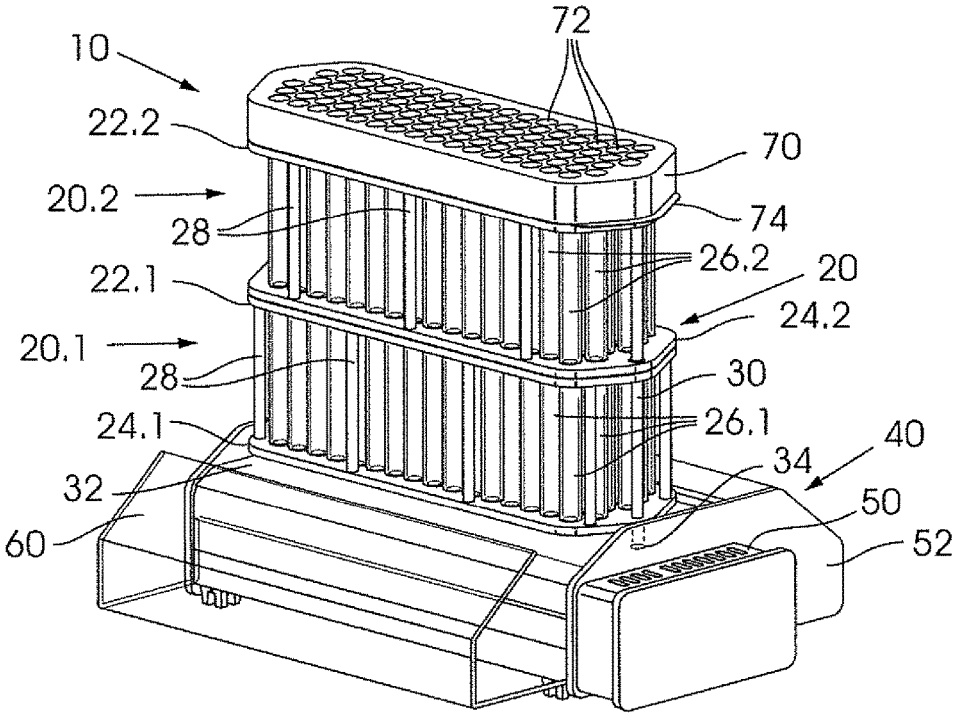
FIG. 1 shows a front perspective view of a tube filling apparatus according to a first embodiment of the invention.

Referring to the drawings, in which like numerals indicate like features, a non-limiting example of a tube filling apparatus in accordance with the invention is generally indicated by reference numeral 10.

The word "tube" as used throughout this specification is used in a broad sense to describe both cylindrical and conical holders wherein processed plant material, such as a herb mixture, for example, can be received. It is believed that the apparatus 10 could find particular application in filling tubes, typically paper, cellulose or hemp tubes, with a herb mixture which can then be smoked. All reference to orientation and position such as "upper", "lower", "top", "bottom", "vertical" and "horizontal" is made with reference to apparatus 10 in use.

Referring now to FIG. 1, the apparatus 10 includes a filling assembly 20 mounted on a base 40 and a filling tray 70 which is removably mounted on the filling assembly.

The filling assembly 20 includes a lower assembly 20.1 and an upper assembly 20.2. In use, the upper assembly 20.2 is mounted removably on the lower assembly 20.1 as shown in FIG. 1. The construction of the upper and lower assemblies are similar in that each assembly includes a top support, a bottom support and a number of cylindrical receptacles running between the top of bottom supports. In the accompanying drawings the top support, bottom support and receptacles of the lower assembly 20.1 are indicated by the numerals 22.1, 24.1 and 26.1 respectively while the top support, bottom support and receptacles of the upper assembly 20.2 are indicated by the numerals 22.2, 24.2 and 26.2 respectively.

The top and bottom supports of both assemblies are in the form of acrylic plates which are arranged substantially horizontally such that the receptacles 26.1, 26.2 are arranged substantially vertically. Each receptacle defines a tube receiving recess being open at both ends to receive a tube therein and allow it to pass therethrough. Each recess in the receptacles 26.1, 26.2 is dimensioned to allow one of the tubes to move substantially freely along its longitudinal direction. More about this is said below.

From FIG. 1 it should be clear that the upper assembly 20.2 is, in use, carried on top of the lower assembly 20.1 so that the tube receiving recesses in the upper assembly align with the recesses in the lower assembly. The bottom support 24.2 of the upper assembly 20.2 and the top support 22.1 of the lower assembly 20.1 include complementally shaped locating means (not shown in the accompanying drawings) which locate the upper assembly on the lower assembly.

Figure 3:
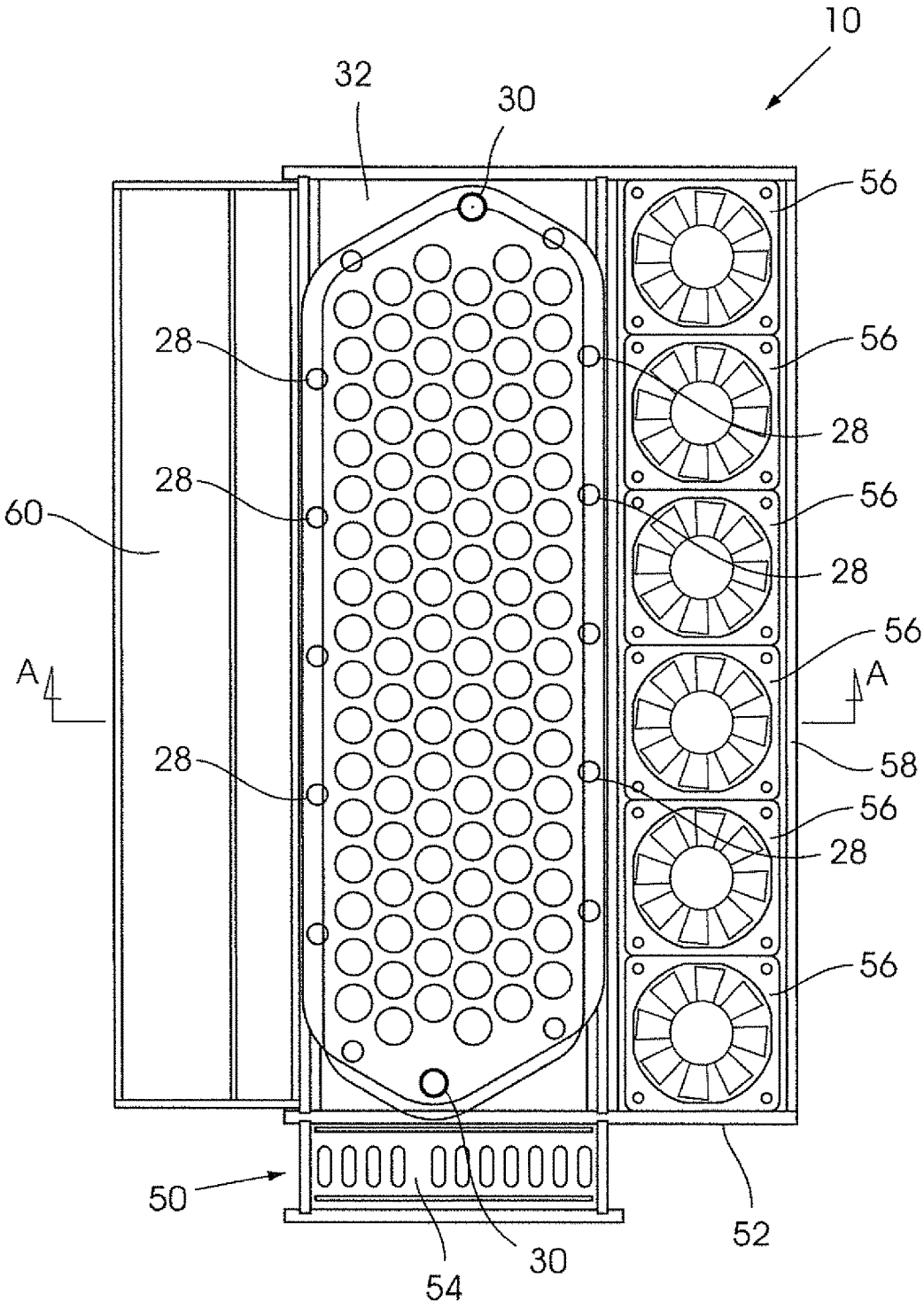
FIG. 3 shows a top view of the tube filling apparatus of FIG. 1.

The upper and lower assemblies each further includes support posts 28 running between its top and bottom supports. The supports posts 28 are arranged along the periphery of the top and bottom supports as shown in FIG. 3 to provide structural support to the assemblies 20.1, 20.2.

Figure 4:
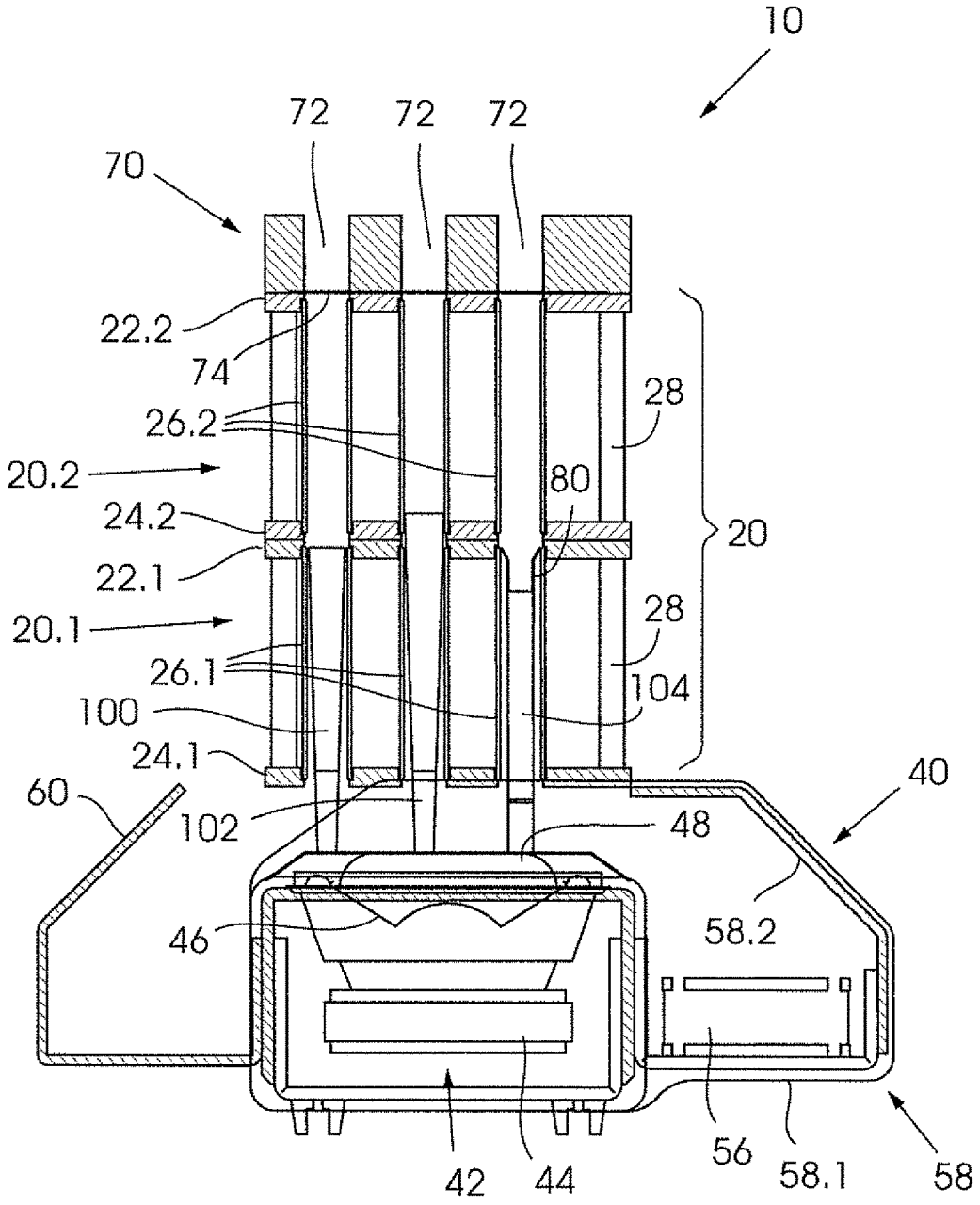
FIG. 4 shows a cross-sectional view of the apparatus taken along A-A as shows in FIG. 4.

The filling assembly 20 is mounted on the base 40 by means of two legs 30, one located at each of its longitudinal ends. In the illustrated embodiment the legs 30 are in the form of pillars extending from the filling assembly 20 into the base 40. The height of the filling assembly can therefore be adjusted by changing the length of the pillars 30 so as to accommodate tubes of different lengths. It must be understood that the height of the lower assembly 20.1 above the vibration plate 32 is preferably adjusted so that the top of the tubes in the receptacles 26.1 protrude from the receptacles, thereby allowing for easy extraction of the tubes from the lower assembly. With the top of the tubes extending from the receptacles they can easily be gripped to remove them from the receptacles. It is envisaged that the length of the tubes will typically vary from about 75 and 110 mm, preferably about 79 to 109 mm. Tubes of different lengths are shown in FIG. 4 and indicated by the numerals 100, 102 and 104 respectively.

In the preferred embodiment, the filling assembly, and in particular the receptacles 26.1, 26.2, are transparent to allow visual inspection of the process of filling the tubes with the herb mixture. It is envisaged that the transparent receptacles may be manufactured from glass or similar materials to reduce the build-up of static charges as a result of friction between the tubes and receptacles.

Returning to FIG. 1, the apparatus 10 further includes a vibration plate 32 located between the base 40 and the filling assembly 20 so that, in use, it provides a surface on which the tubes rest when they are located inside the tube receiving recesses of the filling assembly. From FIGS. 1 and 2 it can be seen that the pillars 30, which connect the filling assembly 20 to the base 40, extend through holes 34 in the vibration plate, thereby locating it on the base. Although the vibration plate 32 is secured in a generally horizontal plane by the pillars 30 it is allowed to move freely in a generally vertical direction. It must be clear that the vibration plate 32 is capable of moving independently from the filling assembly 20 and base 40.

As mentioned above, the filling assembly 20 is height adjustable by changing the length of the pillars extending from the base 40. During operation of the apparatus 10 the filling assembly 20 will typically be located between about 5 to 20 mm, preferably about 15 mm, above the vibration plate.

Referring now to FIG. 4, the apparatus 10 includes vibrating means located in the base 40 and connected to the vibration plate 32. In the preferred embodiment of the apparatus 10, the vibrating means is in the form of a transducer which converts electrical energy into mechanical displacement so as to move a diaphragm or pole piece, preferably a speaker 42 which is connected to the base 40 with the use of bolts and nuts. A person familiar with the art of loudspeakers will know that the speaker includes a driver 44 driving a diaphragm or speaker cone 46. In the apparatus 10 the vibration plate 32 is coupled to the speaker cone 46 with the use of a coupling element in the form of a pressed aluminium dome 48 which is mounted directly onto the speaker cone. The dome 48 is typically glued onto the speaker cone 46. As can be seen from FIG. 4, the coupling dome 48 is flattened at its top end to create a support surface for supporting the vibration plate. To allow the vibration plate 32 to vibrate in harmony with the speaker dome 46 it is connected to the coupling dome by, for example, gluing the flattened surface to the underside of the vibration plate. It must be understood that this creates a direct connection between the vibration plate 32, speaker cone 46 and speaker driver 44.

It is envisaged that a number of speakers 42 can be used to increase the force that is transferred to the vibration plate 32. For example, the preferred embodiment of the apparatus 10 has three speakers 42 mounted along the length of the base 40.

It is envisaged that in an alternative embodiment (not illustrated in the accompanying drawings) the vibrating means could be in the form of at least one solenoid.

It has been found that a surface displacement of between about 5 to 7 mm is required for successfully filling the tubes to the desired herb density. Accordingly, the vibration plate 32 is light weight in that it is manufactured from thin sheet metal, preferably aluminum. The inventor has identified that the surface area and weight of the vibration plate 32, including the attached diaphragm assembly, are critical to the effective rise time and subsequent dead stroke time required for a successful filling process.

To control the vertical displacement of the vibration plate 32 the apparatus includes an automated electronic controller (not shown in the accompanying drawings). The controller has a micro-controller with embedded software. The micro-controller, in turn, drives a linear output stage, comprising either bipolar BJT or MOSFET transistors, and the array of speakers attached to the vibration plate. The controller is powered by an AC power adapter having an input of 100-240 VAC and DC output of 36 VDC, thereby providing additional safety for the user. All outputs are protected from over voltage and fused, including double input fusing, in case of over-voltage adapter failure.

An advantage of using the microprocessor based controller is that it not only allows frequency or amplitude control but also allows a user to select optimised pre-sets for different sized tubes, tube materials, grades of plant material and moisture content of the material. The selected pre-set runs an optimised vibration frequency and amplitude for each stage, thereby automating the filling process.

By using the controller as discussed above an operating frequency range of the vibration plate 32 of between about 4 Hz to about 20 Hz is achieved. It must be understood that if the frequency is too low the tubes would come into rest on top of the vibration plate while if it is too high gravity would not have enough time to accelerate the falling tubes over an appreciable distance. In the preferred embodiment an average vibrating frequency of between about 6 Hz to about 14 Hz is used, thereby delivering a vertical displacement of about 6 mm. In other words, the vibration plate 32 has a positive vertical travel of about 6 mm from its resting position. It has been found that a vertical displacement of about 6 mm of the vibration plate 32 results in displacement of the tubes between about 30 and 60 mm. In certain instances a tube displacement of more than 80 mm can be achieved by increasing the amplitude of the vibrations and optimising the frequency based on the mass of the items being lifted.

In the preferred embodiment of the apparatus 10 an amplifier is used which induces no negative displacement i.e. it does not use conventional push/pull topology to oscillate the speaker's amplitude. A BJT Darlington output stage is used as a switch in full saturation mode to reduce heat dissipation, simplify circuitry and reduce RFI. Alternatively, MOSFETS's or similar power switching devices can be used, including various output stage topologies and classes. Push/pull audio amplifier topology can be used successfully in an alternative embodiment wherein sufficient space is provided between the filling assembly 20 and the vibration plate 32, for example.

Figure 2:
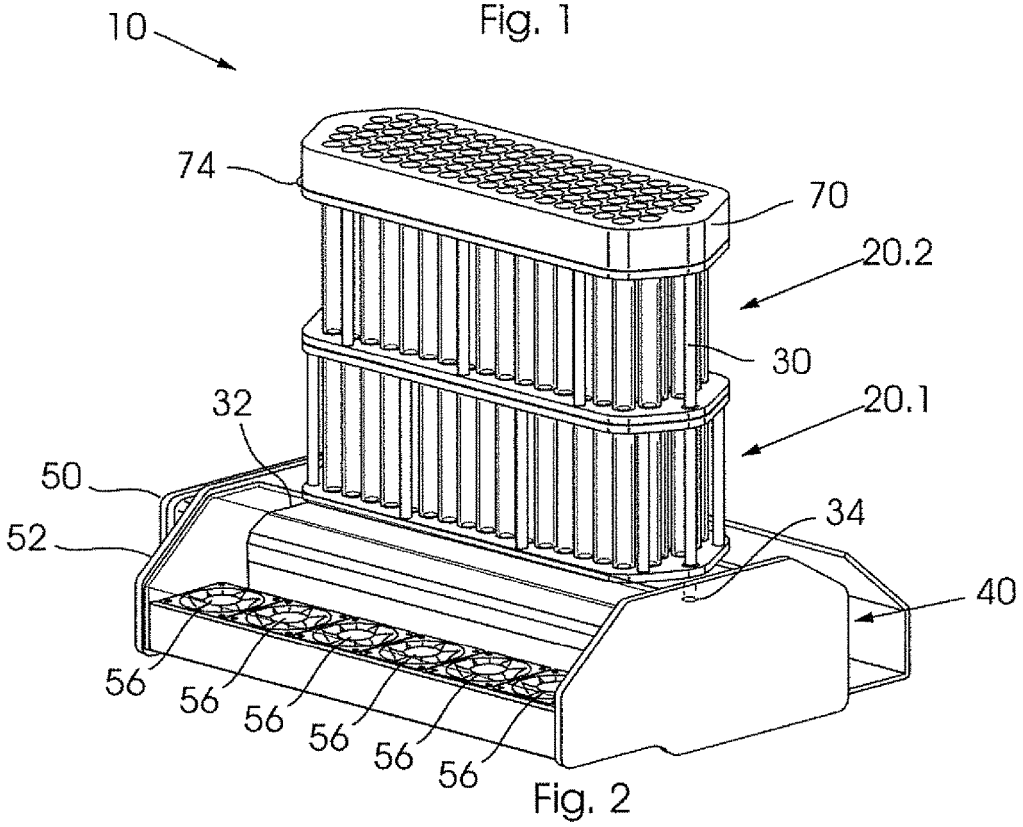
FIG. 2 shows a rear perspective view of the tube filling apparatus of FIG. 1.

The electronic components of the controller are included in a compartment 50 of the base 40, which can be seen in FIGS. 1 to 3. The compartment 54 is connected to a side plate 52 of the base. As shown in FIG. 3, the top wall of the compartment has a backlight LED display 54. A control panel (not shown in the accompanying drawings) is also mounted on the controller compartment and includes recessed push buttons for pre-set selections and starting the filling process.

The apparatus 10 further includes a number of fans 56 mounted in a removable fan tray 58 having a body 58.1, which is connected to the base 40, and a cover 58.2 for directing the airflow resulting from operation of the fans across the vibration plate 32. In use, any excess herb mixture spilt onto the vibration plate 32 is blown off it by the stream of air directed across the plate. To collect the herb mixture blown off the vibration plate 32 the apparatus 10 includes a collector tray 60. The collector tray 60 is connected to the base 40 on a side of the base which is opposite the side to which the fan tray 58 is connected. The collector tray 60 is removably connected to the base 40 so that the herb mixture collected therein can be easily dispensed.

The fan tray cover 58.2 is also removably connected to the fan tray body 58.1 so that it can be removed to allow access to the fans 56. In the preferred embodiment of the apparatus 10 the fan tray cover 58.2 is magnetically coupled to the fan housing 58.1.

The illustrated embodiment of the apparatus 10 further has a filling tray 70 to assist with the filling of the paper tubes. The filling tray 70 is connectable to the upper assembly 20.1 in a position wherein it is, in use, located above the upper assembly. The filling tray 70 has a number of recesses 72 extending through it. As shown in FIG. 4, the recesses 72 in the filling tray 70 line up with the tube receiving recesses in the filling assembly 20 so that the herb mixture can pass from the recesses in the filling tray into the filling assembly when mounted thereon. To control the flow of herb mixture from the filling tray 70 to the filling assembly 20, the apparatus 10 includes a removable slide plate 74 which is receivable between the filling tray and the upper assembly 20.2. In the accompanying drawings the slide plate 74 is illustrated as a thin plate made from steel sheeting, preferably stainless steel sheeting.

When located between filling tray 70 and the upper assembly 20.2 the slide plate 74 blocks off the recesses 72 in the filling tray from the recesses in the upper assembly 20.2. In use, the slide plate 74 is removed once the recesses 72 in the filling tray 70 have been filled with the herb mixture in order to allow the herb mixture to fall into the tubes inside the filling assembly 20. The slide plate 74 allows for the dispensing of accurate and consistent quantities of herb mixture. It must be understood that the quantity of herb mixture being dispensed can be changed by changing the volume of the recesses 72 in the filling tray 70.

Figure 5:
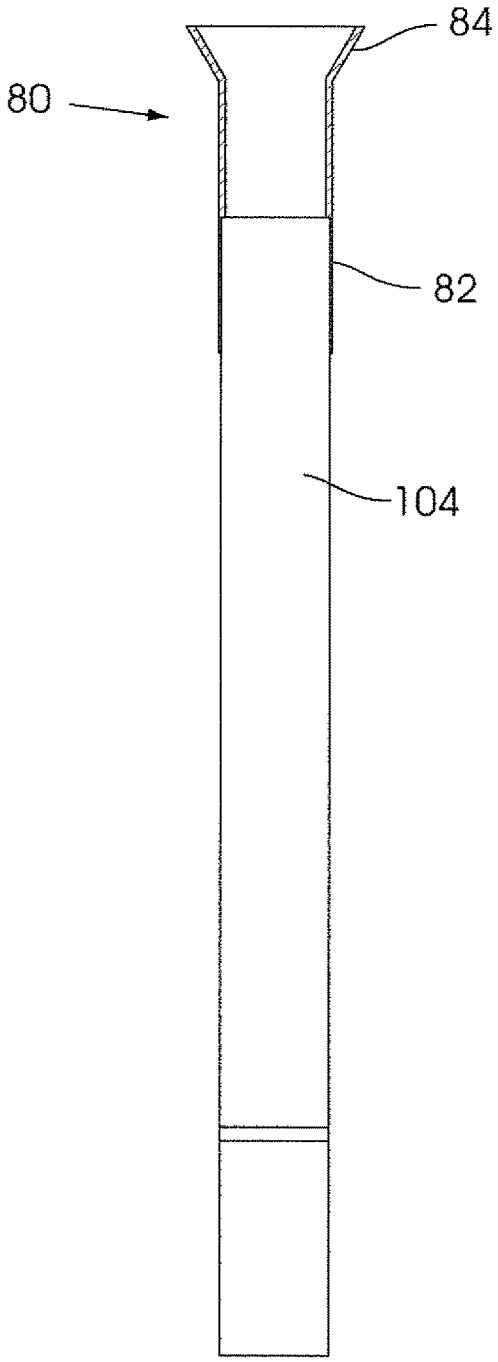
FIG. 5 shows a cross-sectional view of a hopper attachment of the apparatus of FIG. 1.
Figure 6:
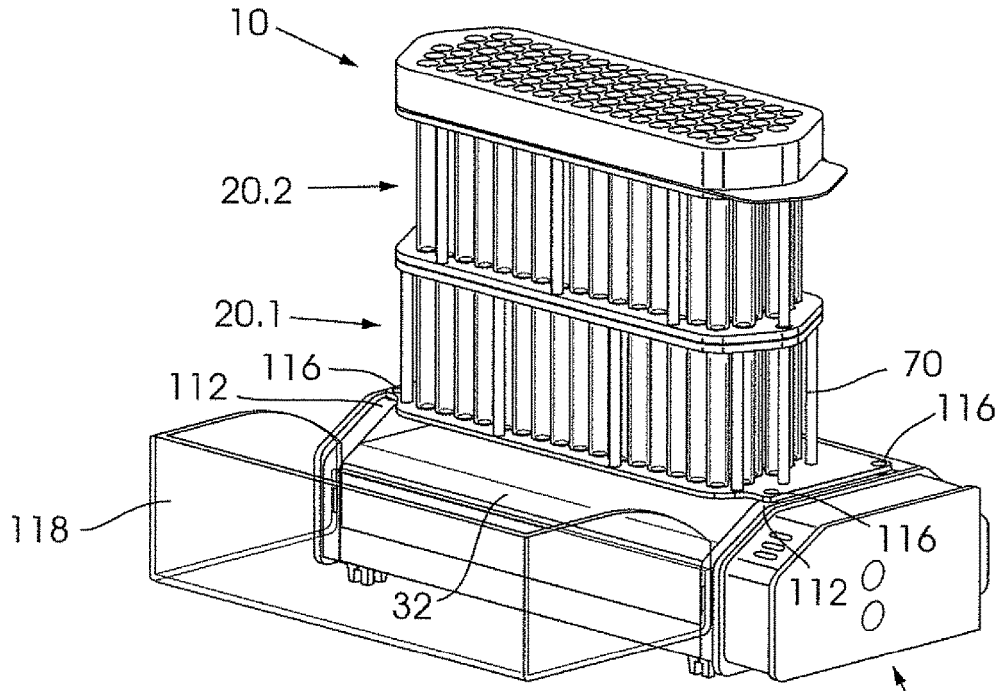
FIG. 6 shows a front perspective view of a tube filling apparatus according to a second embodiment of the invention.
Figure 7:
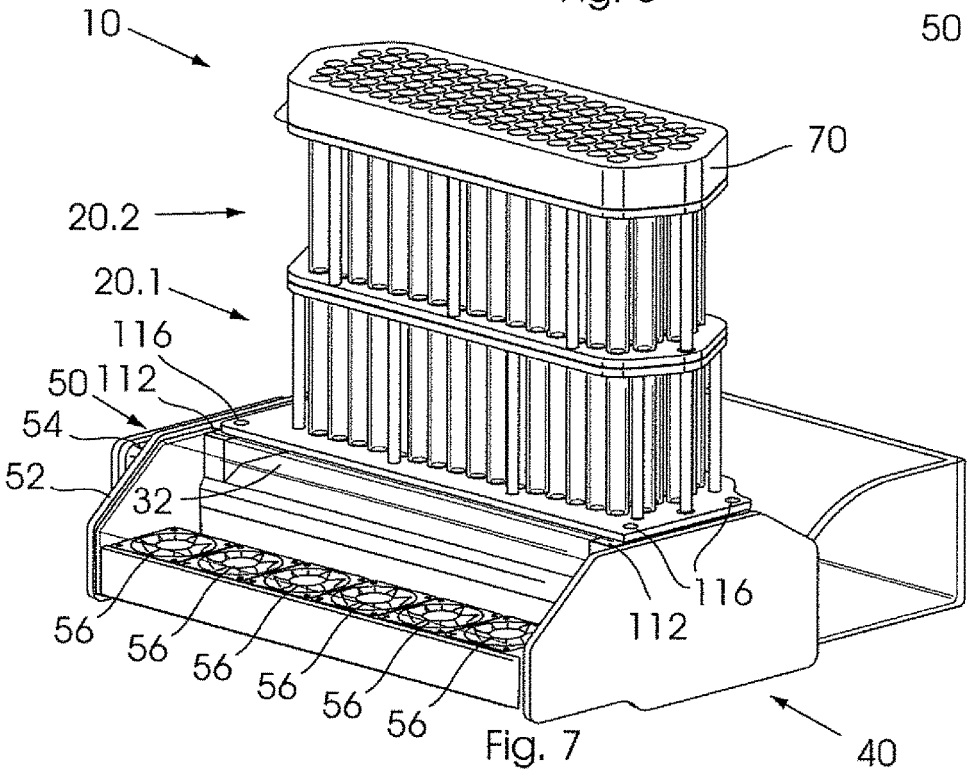
FIG. 7 shows a rear perspective view of the tube filling apparatus of FIG. 6.
Figure 8:
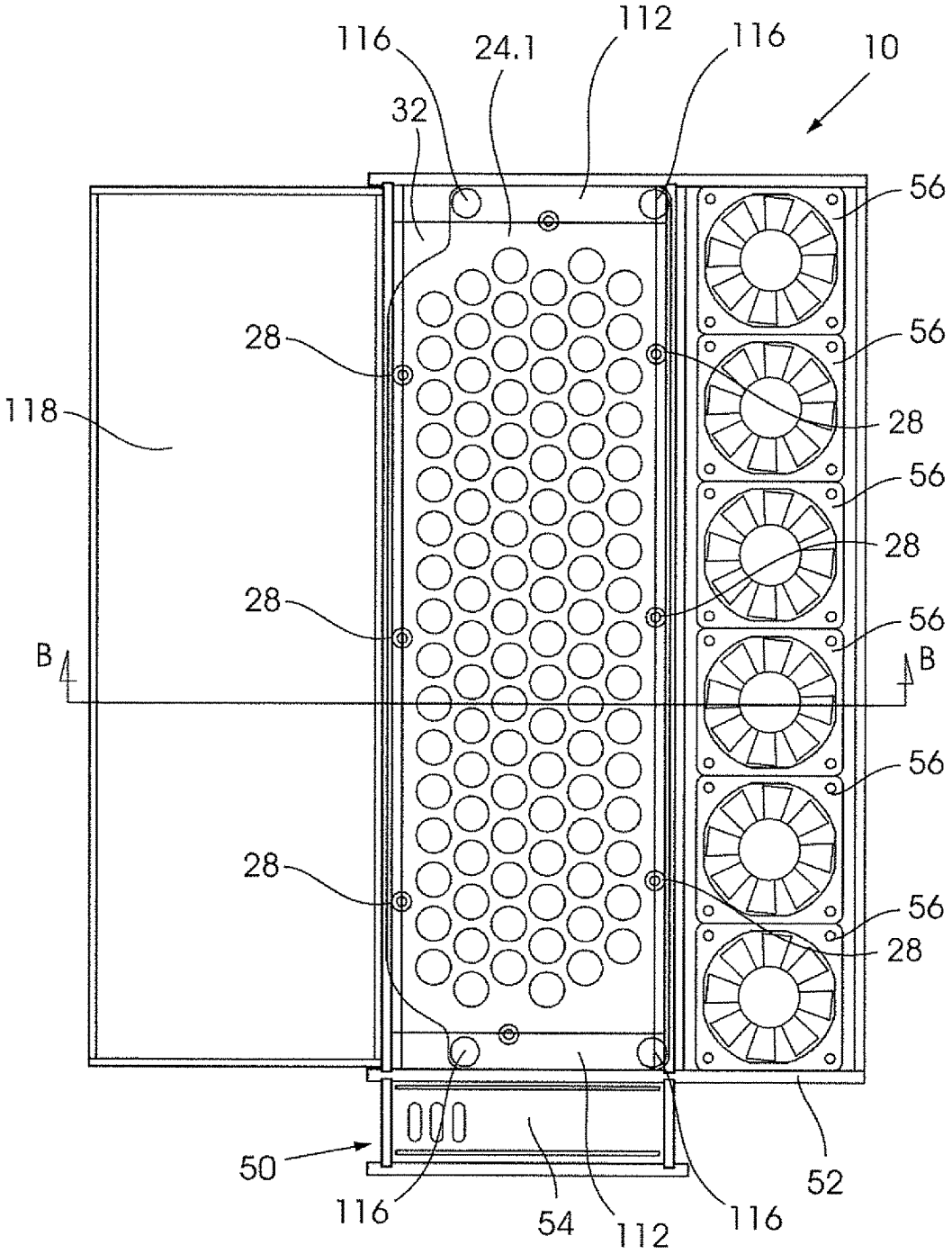
FIG. 8 shows a top view of the tube filling apparatus of FIG. 6.

As mentioned above, the apparatus 10 can be used to fill of both cylindrical and conical tubes. It is envisaged that a hopper attachment 80 (FIGS. 4 and 5) can be used to assist with the filling of cylindrical tubes, such as the one indicated by the numeral 104 in FIG. 4. The hopper attachment has a body 82 with a flared head 84 to reduce the amount of herb mixture which is spilt during the filling process. When attached to the hopper attachment 80 the tube is received in the body 82 with the flared head facing upwards when the tube is inserted into the tube receiving recesses of the filling assembly 20.

Although the method of filling tubes with a herb mixture using the apparatus 10 should be clear from the above description it will now be described in greater detail.

The method typically commences with the assembling of the apparatus 10 including the placing of the upper assembly 20.1 on top of the lower assembly 20.2. Next the paper tubes are inserted into the recesses defined by the vertically extending receptacles of the filling assembly. The conical paper tubes are placed in the recesses with their larger ends at the top and their smaller diameter, lower ends resting on top of the vibration plate 32. The filling tray 70 is then prepared with the slide plate 74 in place, blocking off the recesses 72. With the slide plate in place, the filling tray 70 is then filled with herb mixture to a desired level and thereafter located in place above the upper filling assembly 20.2. After having filled all of the recesses 72, or alternatively the desired number of recesses, an appropriate pre-set is selected and the start button is depressed. The slide plate 74 is removed to allow the herb mixture to be dispensed down the recesses in the filling assembly 20 and into the tube cavities. By pressing the start button electrical signals are sent to the speaker drivers which, in turn, cause their speaker cones, the coupling domes and ultimately the vibration plate to vibrate. The vibration of the vibration plate causes the tubes to move freely back and forth, i.e. up and down in the illustrated embodiment, inside the receptacles in the filling assembly while the filling assembly is kept stationary. It must be understood that the tubes reciprocate or oscillate linearly inside the receptacles as a result of the vibrational movement of the vibration plate. During the filling process the excess herb mixture that is spilt onto the vibration plate is collected in the collection tray. This is done by causing a flow of air over the vibration plate towards the collection tray. On completion of the filling process, i.e. when a desired herb mixture density inside the tubes has been reached, the apparatus is automatically switched off based on the pre-set selected. Thereafter, the upper filling assembly is removed from the lower assembly to expose the upper ends of the filled tubes which can now be removed by gripping the exposed ends. The filled tubes can easily be closed off and packaged for use.

An advantage of the apparatus 10 is that a fast positive up-stroke is achieved with a longer dead stroke as a result of the use of a lightweight vibration plate in combination with a loudspeaker. The term dead stroke is used to refer to the "off time" of the loudspeakers when the vibration plate is accelerated downwards under the force of gravity and in conjunction with the loudspeaker compliance (spider, surround and diaphragm assembly). The longer dead stoke of the apparatus 10 allows gravity more time to accelerate the speed of the falling tubes and herb mixture over a greater distance. As a result, when the falling tubes are impacted by the rising surface of the vibration plate, a fast response time is achieved. A key benefit of optimising the vibration plate frequency is that it allows for timed impacts of the individual tubes that are dispersed evenly throughout the dead stroke time. This also ensures the mass of the items being filled is distributed evenly throughout the positive up stroke time domain, maximising the effectiveness of the vibration plate and its associated force.

A second embodiment of the tube filling apparatus in accordance with the invention will now be described with reference to FIGS. 6 to 10 of the accompanying drawings. As mentioned above, in the accompanying drawings like numerals indicate like features.

Figure 9:
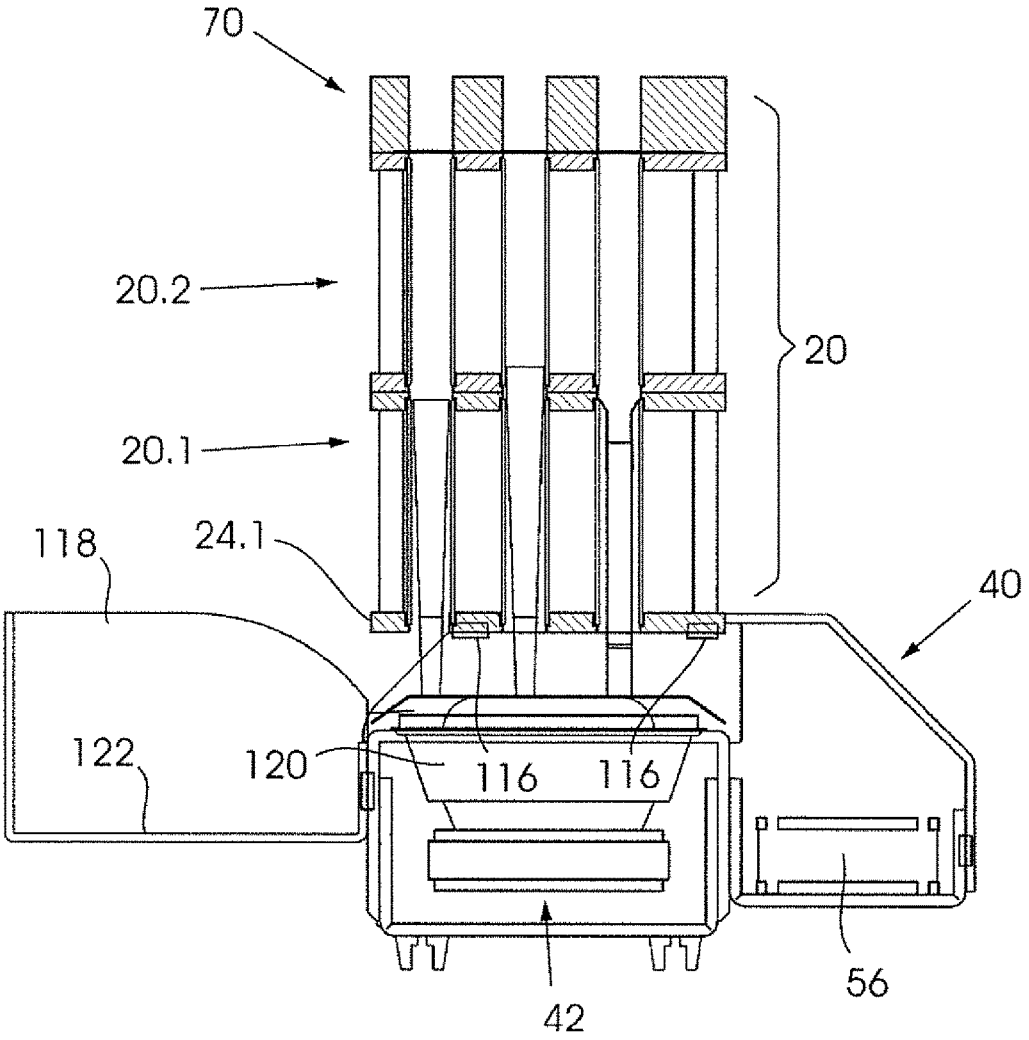
FIG. 9 shows a cross-sectional view of the apparatus taken along B-B as shows in FIG. 8 wherein a filling assembly of the apparatus is located on a base of the apparatus.
Figure 10:
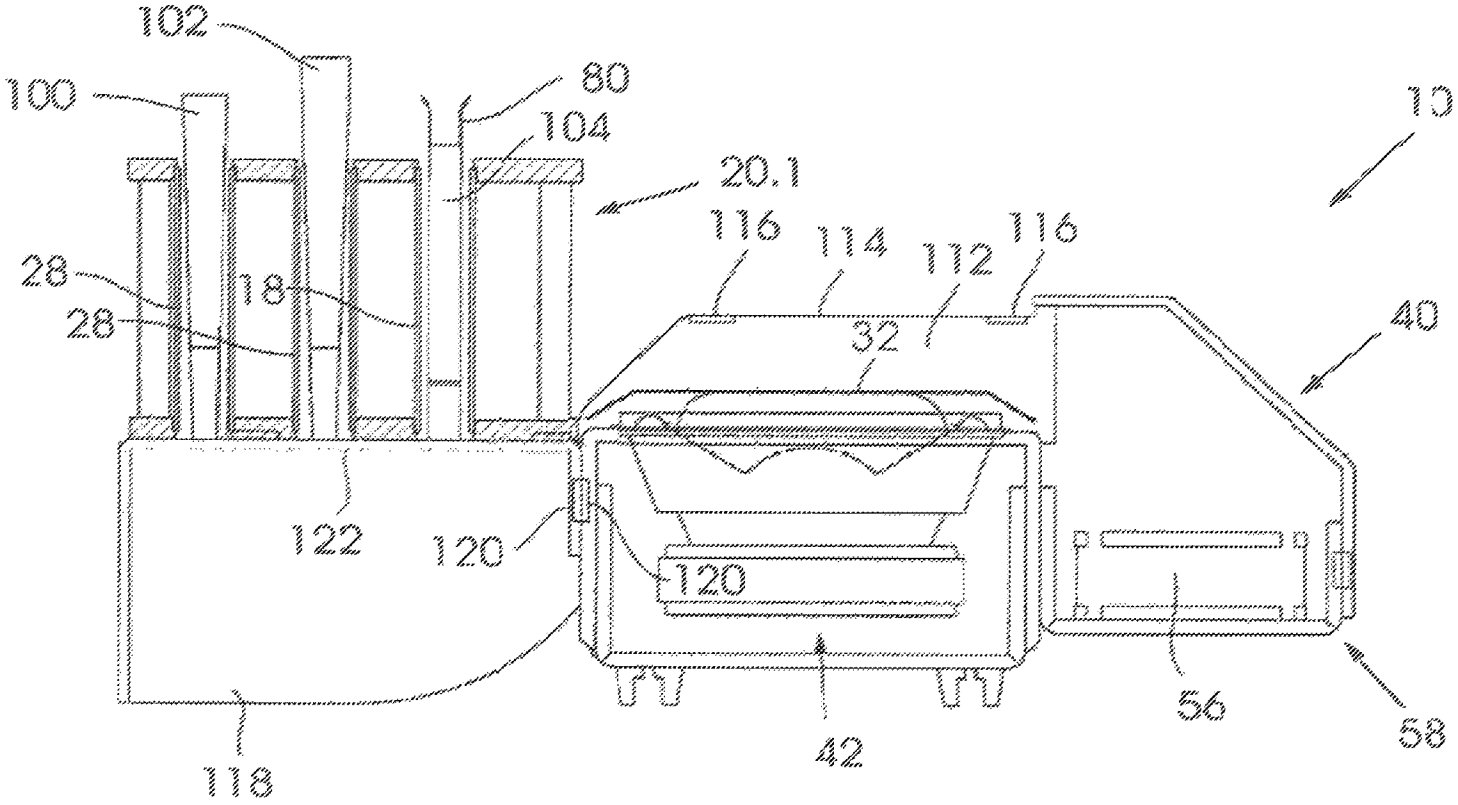
FIG. 10 shows a cross-sectional view of the apparatus taken along B-B as shows in FIG. 8 wherein a lower assembly of the filling assembly rests on a working surface provided by a collector tray.

The reference numeral 110 is generally used in FIGS. 6 to 10 to indicate the second embodiment of the tube filling apparatus. The apparatus 110 is similar in construction than the apparatus 10 and, accordingly, only the differences will be discussed in any detail. Instead of two legs or pillars 30 of the apparatus 10, the filling assembly 20 of the apparatus 110 is supported on the base 40 by means of supports 112. The supports 112 are in the form of upstanding ridges located at the longitudinal opposed ends of the base 40. Each ridge 112 has a support surface 114, as can be seen in FIG. 10, on which a portion of the lower assembly 20.1 is received when located on the base. From FIGS. 6 and 7 it can be seen that the bottom support 24.1 of the lower assembly 20.1 is shaped to form the portions of the lower assembly which are located on the support surfaces 112 when located on the base 40. The bottom support 24.1 and the ridges 112 carry complementally shaped attachment formations for, in use, attaching the filling assembly on the base. In this embodiment, the attaching formations are in the form of magnetic elements which are located on the lower support and base so that they align with one another to attach the lower assembly releasably on the base when located thereon. The magnetic elements 116 allow for quick and easy removal of the lower assembly 20.1 off the base 40 when required.

The apparatus 110 further includes a collector tray 118 which is design to be attachable to the base 40 in two different positions or orientations, the first being a collecting orientation wherein it is open to the top so that the herb mixture blown off the vibration plate 32 by the fan blowers 56 can be collected therein, and the second being a supporting orientation wherein it provides a supporting surface on which the lower assembly 20.1 can be placed when removed from the base. FIGS. 9 and 10 show the collector tray 118 attached to the base 40 in its collecting and supporting orientations respectively. In both orientations the collector tray 118 is attached to the base 40 by means of magnetic elements 120 located in the tray and base respectively, thereby allowing the tray to be removably attached to the base. It must be clear that in order to change the orientation of the tray 118 it is first detached from the base 40, flipped upside down i.e. rotated through 180 degrees and then reattached to the base 40 in its new orientation. As illustrated in FIG. 10, by rotating the tray 180 before reattaching it to the base 40 its floor 122 forms a supporting surface on which the lower assembly 20.1 can be placed when removing the tubes from the recesses 28 after the filling process has been completed.

When using the apparatus 110 the method of filling may further include the steps of removing the collector tray, changing its orientation with respect to the base and reattaching it to the base in a new orientation so that its floor creates a working surface. The method may further include the steps of removing the lower filling assembly from the base and placing it on the working surface so that the tubes therein protrude from the receptacles in the lower filling assembly so that they can be easily extracted. It must be understood that by placing the lower assembly on the working surface the tubes, which are movable vertically in the receptacles, are pushed upward so that their top ends protrude from the receptacles. This can be seen in FIG. 9. The tubes can now be removed from the lower assembly by gripping their top ends and lifting them out of the assembly.

The invention claimed is:

1. A tube filling apparatus for filling tubes with a herb mixture, the apparatus including:

a base;

a filling assembly mountable on the base, the filling assembly having a plurality of tube receiving recesses extending substantially vertically and being open at both ends such that tubes to be filled may be received at upper ends of the plurality of tube receiving recesses to move freely along their longitudinal direction sinking into the plurality of tube receiving recesses to protrude partially from lower ends of the plurality of tube receiving recesses, wherein the tubes sunken into the plurality of tube receiving recesses may be filled with the herb mixture via the upper ends of the plurality of tube receiving recesses;

a vibration plate being locatable in a generally horizontal plane between the base and the filling assembly, and spaced apart by a predetermined distance below the filling assembly such that the tubes protruding from the lower ends of the plurality of tube receiving recesses may contact a surface of the vibration plate when they are located in the plurality of tube receiving recesses; and a transducer which is in connection with the vibration plate, the transducer configured to vibrate the vibration plate in a generally vertical direction, independently of the filling assembly, wherein the filling assembly is kept stationary while the vibration plate vibrates such that the tubes may oscillate freely up and down inside the plurality of tube receiving recesses, accelerated downward by gravity and intermittently impacted by the surface of the vibration plate for compacting the herb mixture inside the tubes.

2. A tube filling apparatus according to claim 1, wherein the transducer is configured to oscillate electro-mechanical energy to the vibration plate.

3. A tube filling apparatus according to claim 2, wherein the transducer is a speaker.

4. A tube filling apparatus according to claim 3, wherein the speaker is connected to the vibration plate by means of a coupling element which connects a speaker cone of the speaker to the vibration plate so that the vibration of the speaker cone is, in use, transferred to the vibration plate, thereby vibrating the tubes resting on the vibration plate.

5. A tube filling apparatus according to claim 4, wherein the transducer comprises three speakers, each being connected to the vibration plate by means of the coupling element.

6. A tube filling apparatus according to claim 1, wherein the vibration plate is manufactured from aluminum sheeting.

7. A tube filling apparatus according claim 1, wherein the filling assembly is removably attachable to the base at a fixed height above the base by means of supports, thereby allowing the filling assembly to be removed from the base.

8. A tube filling apparatus according to 7, wherein the filling assembly is magnetically attachable to the base.

9. A tube filling apparatus according to claim 1, wherein the filling assembly includes a lower assembly and an upper assembly, which is, in use, mounted removably on top of the lower assembly, wherein the upper and lower assemblies have a number of tube receiving recesses, and wherein the tube receiving recesses in the upper assembly align with the recesses in the lower assembly when mounted on the lower assembly.

10. A tube filling apparatus according to claim 9 wherein the filling assembly is height adjustable with respect to the base in order to adjust the distance between the lower assembly and the vibration plate located between the lower assembly and the base, thereby facilitating the extraction of filled tubes after the filling has been completed.

11. A tube filling apparatus according to claim 10, wherein the filling assembly is mounted on the base by means of adjustable pillars.

12. A tube filling apparatus according to claim 9, wherein each of the upper and lower assemblies has a top support, a bottom support and a series of receptacles running between the top and bottom supports, wherein the receptacles define the tube receiving recesses in which the tubes are, in use, received.

13. A tube filling apparatus according to claim 12, wherein receptacles are transparent so as to allow visual inspection of the process of filling the tubes with the herb mixture.

14. A tube filling apparatus according to claim 13, wherein the transparent receptacles are manufactured from glass to reduce the build-up of static charges as a result of friction between the tubes and receptacles.

15. A tube filling apparatus according to claim 9, including a filling tray being connectable to the upper assembly in a position wherein it is, in use, located above the upper assembly, wherein the filling tray includes recesses which correspond with the recesses in the upper assembly when mounted thereon.

16. A tube filling apparatus according to claim 15, including a sliding plate being receivable between the filling tray and the upper assembly so as to block off the recesses in the filling tray from the recesses in the upper assembly.

17. A tube filling apparatus according to claim 16, wherein the sliding plate is removable so as to allow it to be removed after the recesses in the filling tray have been filled with the herb mixture, thereby allowing the herb mixture to fall into the tubes inside the filling assembly upon removal of the sliding plate.

18. A tube filling apparatus according to claim 1, including a fan blower mounted in a fan housing having a body, which is connected to the base, and a cover for directing the airflow over the vibration plate.

19. A tube filling apparatus according to claim 18, wherein the cover is removably connectable to the fan housing body so that it can be removed to allow access to the fan blower.

20. A tube filling apparatus according to claim 19, wherein the fan housing cover is magnetically coupled to the fan housing.

21. A tube filling apparatus according to claim 18, including a collector tray being connected to the base on the side of the base which is opposite to the side to which the fan housing is connected, thereby allowing excess herb mixture to be blown off the vibration plate and into the collector tray.

22. A tube filling apparatus according to claim 21, wherein the collector tray is removably connectable to the base so that the excess herb mixture collected therein can be re-used.

23. A tube filling apparatus according to claim 21, wherein the collector tray is reversible, i.e. capable of being re-attached to the base in an orientation which differs 180 degrees from its initial orientation, so that its floor creates a working surface when it is attached to the base in its reversed orientation.

24. A method of filling tubes with a herb mixture using an apparatus which has a filling assembly mountable on a base, a vibration plate located between the filling assembly and the base, and a transducer which is in connection with the vibration plate, wherein the filling assembly has a plurality of tube receiving recesses extending substantially vertically and being open at both ends, wherein the vibration plate is located in a generally horizontal plane between the base and the filling assembly, and spaced apart by a predetermined distance below the filling assembly, the method including the steps of:

receiving the tubes to be filled into at upper ends of the plurality of tube receiving recesses to move freely along their longitudinal direction sinking into the plurality of tube receiving recesses to protrude partially from lower ends of the plurality of tube receiving recesses, wherein the tubes sunken into the plurality of tube receiving recesses are filled with the herb mixture via the upper ends of the plurality of tube receiving recesses, wherein the tubes located in the plurality of tube receiving recesses protrude from the lower ends of the plurality of tube receiving recesses and contact a surface of the vibration plate; and using the transducer to vibrate the vibration plate in a generally vertical direction, independently of the filling assembly, wherein the filling assembly is kept stationary while the vibration plate vibrates, wherein the tubes oscillate freely up and down inside the plurality of tube receiving recesses, accelerated downward by gravity and intermittently impacted by the surface of the vibration plate for compacting the herb mixture inside the tubes.

25. A method according to claim 24, wherein the transducer transfers oscillating electro-mechanical energy to the vibration plate.

26. A method according to claim 25, wherein the transducer is a speaker.

27. A method according to claim 25, wherein a displacement of the vibration plate is automatically controlled by means of a microprocessor based controller which allows optimised pre-sets to be selected.

28. A method according to claim 24, wherein a distance of the displacement of the vibration plate is between about 5 to 7 mm.

29. A method according to claim 24, wherein the step of filling the herb mixture via the upper ends of the plurality of tube receiving recesses includes the following steps:

placing a filling tray on top of the filling assembly so that recesses in the filling tray align with the tube receiving recesses in the filling assembly;

blocking off the recesses in the filling tray from the recesses in the filling assembly using a slide plate located between the filling tray and the filling assembly;

placing the herb mixture in the recesses in the filling tray; and removing the slide plate to allow the herb mixture inside the recesses in the filling tray to pass into the tubes located in the recesses inside the filling assembly.

30. A method according to claim 24, further comprising a step of collecting excess herb mixture which is, in use, spilt on the vibration plate in a collection tray.

31. A method according to claim 30, wherein the excess herb mixture is collected in the collection tray by causing a flow of air over the vibration plate towards the collection tray.

32. A method according to claim 30, further comprising steps of removing a collector tray, changing its orientation with respect to the base and re-attaching it to the base in a new orientation so that its floor creates a working surface.

33. A method according to claim 24, further comprising steps of removing the filling assembly from the base and placing it on the working surface so that the tubes therein protrude from the filling assembly so that they can be extracted.

* * * * *